US007225737B2

(12) United States Patent
Gelbart et al.

(10) Patent No.: US 7,225,737 B2
(45) Date of Patent: Jun. 5, 2007

(54) METHOD FOR AUTOMATED PLATEMAKING

(75) Inventors: Daniel Gelbart, Vancouver (CA); Judith Marie Hess, Vancouver (CA)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 0 days.

(21) Appl. No.: 10/730,137

(22) Filed: Dec. 9, 2003

(65) Prior Publication Data

US 2005/0120899 A1 Jun. 9, 2005

(51) Int. Cl.
*B41M 5/00* (2006.01)
*B41N 3/00* (2006.01)

(52) U.S. Cl. ..... 101/463.1; 101/477; 101/481; 101/401.1

(58) Field of Classification Search ..... 101/471, 101/477, 481–485, 463.1; 346/132, 134, 346/138

See application file for complete search history.

(56) References Cited

U.S. PATENT DOCUMENTS

| | | | | | |
|---|---|---|---|---|---|
| 3,677,059 | A | * | 7/1972 | Miller et al. | 72/403 |
| 3,914,974 | A | * | 10/1975 | DeVore | 72/319 |
| 3,984,747 | A | * | 10/1976 | Gerber et al. | 318/632 |
| 4,218,909 | A | * | 8/1980 | Wright | 72/320 |
| 4,458,254 | A | * | 7/1984 | Gerber | 346/134 |
| 4,591,281 | A | * | 5/1986 | Howard et al. | 347/104 |
| 4,594,868 | A | * | 6/1986 | Takeuchi et al. | 72/18.1 |
| 4,595,957 | A | * | 6/1986 | Holthusen | 358/480 |
| 4,684,228 | A | * | 8/1987 | Holthusen | 396/548 |
| 4,816,293 | A | * | 3/1989 | Hiramoto et al. | 427/596 |
| 4,833,985 | A | * | 5/1989 | Kojima et al. | 101/401.1 |
| 4,853,709 | A | * | 8/1989 | Stein et al. | 347/259 |
| 5,255,607 | A | * | 10/1993 | Nishiyama et al. | 101/463.1 |
| 5,488,906 | A | | 2/1996 | Iron et al. | |
| 5,699,740 | A | | 12/1997 | Gelbart | |
| 5,787,812 | A | * | 8/1998 | Shoji | 101/415.1 |
| 5,947,028 | A | | 9/1999 | Montgomery et al. | |
| 5,996,499 | A | * | 12/1999 | Gelbart et al. | 101/467 |
| 6,076,464 | A | | 6/2000 | Okamura | |
| 6,097,475 | A | | 8/2000 | Jakul et al. | |
| 6,112,664 | A | | 9/2000 | Naniwa et al. | |
| 6,247,404 | B1 | | 6/2001 | Okamura | |
| 6,354,208 | B1 | | 3/2002 | Bos et al. | |

(Continued)

FOREIGN PATENT DOCUMENTS

EP 0533543 A1 1/1995

(Continued)

OTHER PUBLICATIONS

NELA Ternes VCP2002 Data sheet, http://www.ternes.com/e/zeitungsdruck/vcp2002.shtml.

(Continued)

*Primary Examiner*—Daniel J. Colilla
*Assistant Examiner*—Marissa Ferguson-Samreth
(74) *Attorney, Agent, or Firm*—David A. Cordeiro

(57) ABSTRACT

A computer-to-plate (CTP) machine is operated using processless printing plates. A plate bender is built directly into the CTP, bending the plate after imaging in order to make it ready for mounting on the printing press, eliminating all intermediate steps. For presses requiring punched holes in addition to the bend in the plate, the required holes are also punched in the CTP machine.

3 Claims, 3 Drawing Sheets

U.S. PATENT DOCUMENTS

| | | | | |
|---|---|---|---|---|
| 6,450,094 | B2 * | 9/2002 | Koppelkamm | 101/415.1 |
| 6,474,236 | B1 | 11/2002 | Naniwa et al. | |
| 6,644,085 | B1 | 11/2003 | Piechocniski | |
| 2003/0127003 | A1 | 7/2003 | Naniwa et al. | |

FOREIGN PATENT DOCUMENTS

| | | | |
|---|---|---|---|
| EP | 0950925 | A2 | 10/1999 |
| EP | 0985528 | A1 | 3/2000 |
| EP | 0898411 | B1 | 5/2003 |

OTHER PUBLICATIONS

NELA Ternes VCP2002 Data sheet, http://www.ternes.com/e/zeitungsdruck/vcp2002 merkmale.shtml.

* cited by examiner

Prior Art

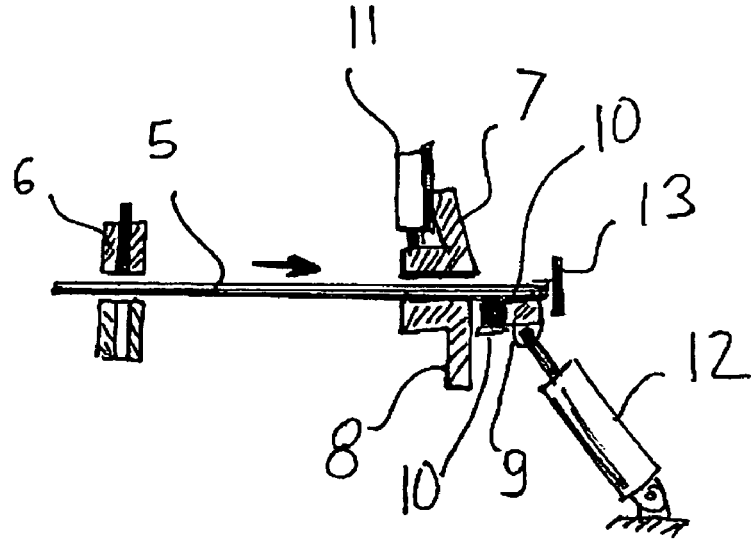
Fig. 4-a
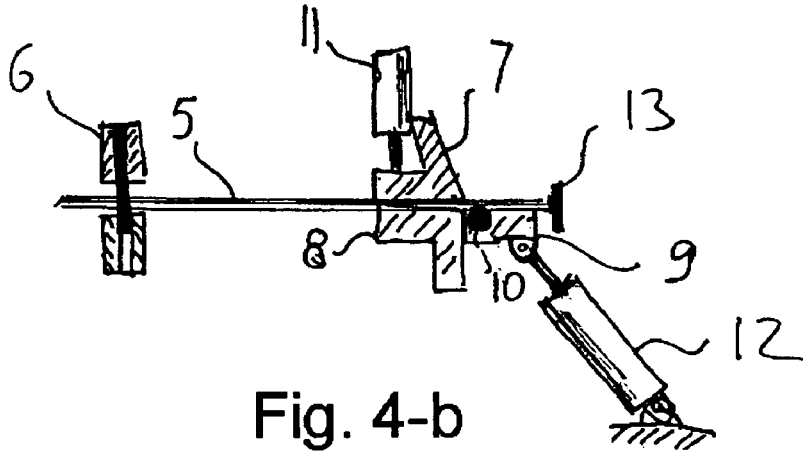
Fig. 4-b
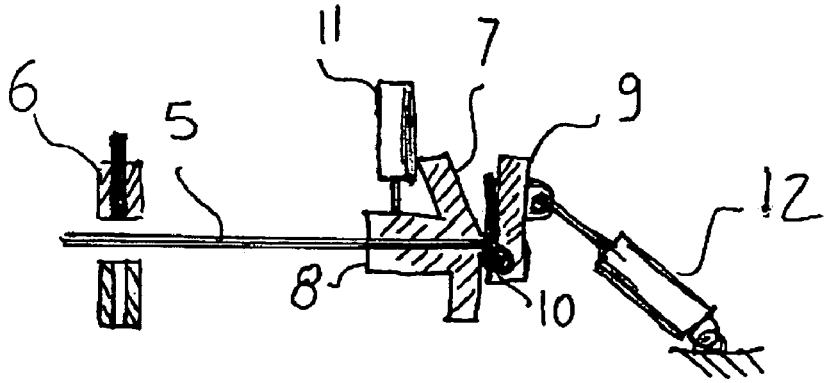
Fig. 4-c

METHOD FOR AUTOMATED PLATEMAKING

FIELD OF THE INVENTION

The invention pertains to the field of platemakig, and, in particular, to the use of Computer-to-Plate imaging machines in order to produce lithographic printing plates.

BACKGROUND OF THE INVENTION

In the process of lithographic printing, also known as offset printing, printing plates are imaged with the data to be printed, processed chemically and mounted on the press. Almost all lithographic printing presses require the edge of the plate to be bent in order to attach it to the plate cylinder inside the press. Modern platemaking relies on Computer-to-Plate (CTP) platesetters, which expose the plate using high-powered lasers or UV light. After exposure, the plate has to be developed by running through a plate processor. Sometimes the plate is also run through an oven for increased durability. After processing, one or two edges of the plate are bent by a plate bender.

In order to improve the registration between the image and the bend (the bend locates the plate on the press), the plate is sometimes punched, either before or after imaging. Some CTP machines have built-in automatic punches in order to eliminate a manual step. The reason for the punching is historical: when plates were made from films, the holes were punched both in the film and in the plate and served to register the film to the plate. Many presses use the bend to locate the plate in the circumferential direction and one or more of the punched holes to locate the plate in the direction of the plate cylinder axis. Some presses do not rely on the punched hole at all, using just the bend and the plate edge to register.

The punching of the plate can be done before imaging, while the plate is in the CTP platesetter, after imaging of the plate but before its processing, or after processing of the plate. When the punching is done as part of the imaging process in the CTP platesetter, it is fully automated. The reason why the bending could not be automated in the same way, is simple: the plate has to be flat in order to be processed, as the processing relies on the uniform nature of a flat plate to expose each part equally to the action of the processing chemicals. This is also the reason why, whenever some bending inside the CTP platesetter was required in the prior art (for example, to curve the plate for a better fit to the drum), any residual bend had to be straightened out before the plate could be fed to the plate processor. The art of platemaking, including CTP platesetters, has been known for at least 20 years and needs no further explanation here. CTP platesetter machines are available from vendors such as Creo (Canada). Automatic punching and bending systems are available from vendors such as Nela-Ternes (USA).

Recently a new type of plate that does not require processing became available for CTP use. Such plates are known as processless or "chemical free" plates. Examples of such plates include: Saphira (sold by Heidelberg of Germany); Applause and Anthem (sold by Presstek of N.H., USA) and Navajo (sold by Kodak Poychrome Graphics, USA). It is an objective of the present invention to provide an apparatus and method by which the manual step of plate bending is eliminated, and the properties of processless plates are employed to bend the plate automatically in a CTP platesetter machine. The full advantages of combining the proprties of processless plates with the step of bending inside the CTP platesetter will become apparent from the following disclosure.

BRIEF SUMMARY OF THE INVENTION

A computer-to-plate (CTP) platesetter machine is operated using processless printing plates. The use of processless plates, when combined with the automation features disclosed in the present invention, can eliminate the manual step of plate bending and enable a fully automated platemaking system, wherein the plate emerges from the CTP platesetter machine ready to be mounted on the printing press. A plate bender is built directly into the CTP platesetter, bending the plate after imaging in order to make it ready for mounting on the printing press, eliminating all intermediate steps. For presses requiring punched holes in addition to the bend in the plate, the required holes are also punched while the plate is in the CTP platesetter.

BRIEF DESCRIPTION OF THE DRAWINGS

FIGS. 4*a*–4*c* are cross sections of a punching and bending device mounted inside a CTP platesetter in three different positions according to one embodiment of the present invention.

DETAILED DESCRIPTION OF THE PREFERRED EMBODIMENT

Figure 1:
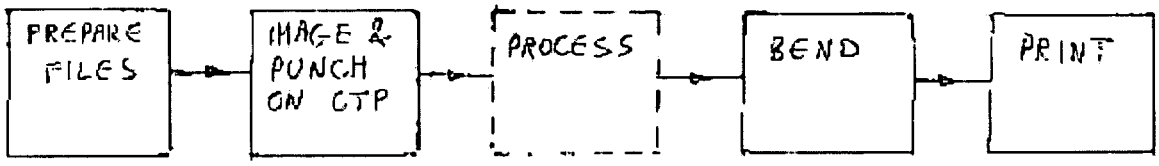
FIG. 1 is a representation of the steps required under prior art to produce a press-ready plate.

The availability of processless lithographic printing plates allows the incorporation of both a punching device and a bending device inside a CTP machine to automatically (i.e. without operator intervention) deliver printing plates ready for the press. The prior art steps are shown in FIG. 1, with "Processing" shown by a dotted line, as it can be eliminated by using processless plates. In the prior art, the step of bending the plates is manually done, as the plates have to be carefully registered to the bender either by the punched holes or by the edges. Electronic edge detection devices built into modern benders facilitate this task. All these steps are well known in the art and the equipment has been commercially available for many years, for example from Nela-Ternes (USA).

One aspect of the invention provides a method for imaging of processless plates in a CTP machine incorporating a bender. A further aspect of the invention provides the incorporation of the bender inside the CTP platesetter.

Figure 2:
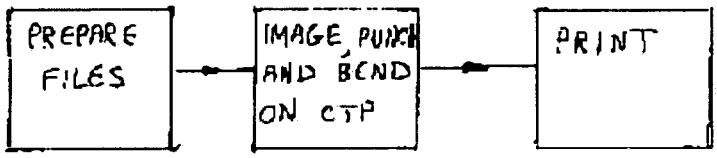
FIG. 2 is a representation of the steps required to produce a press-ready plate according to one embodiment of the present invention.

The steps according to the method of the present invention are shown in FIG. 2. No manual step is required. This allows large numbers of plates to be prepared unattended. Considering that a single color sheet requires between 4 and 8 different plates (more if both sides are printed), the importance of eliminating the manual bending steps is clear.

Figure 3:
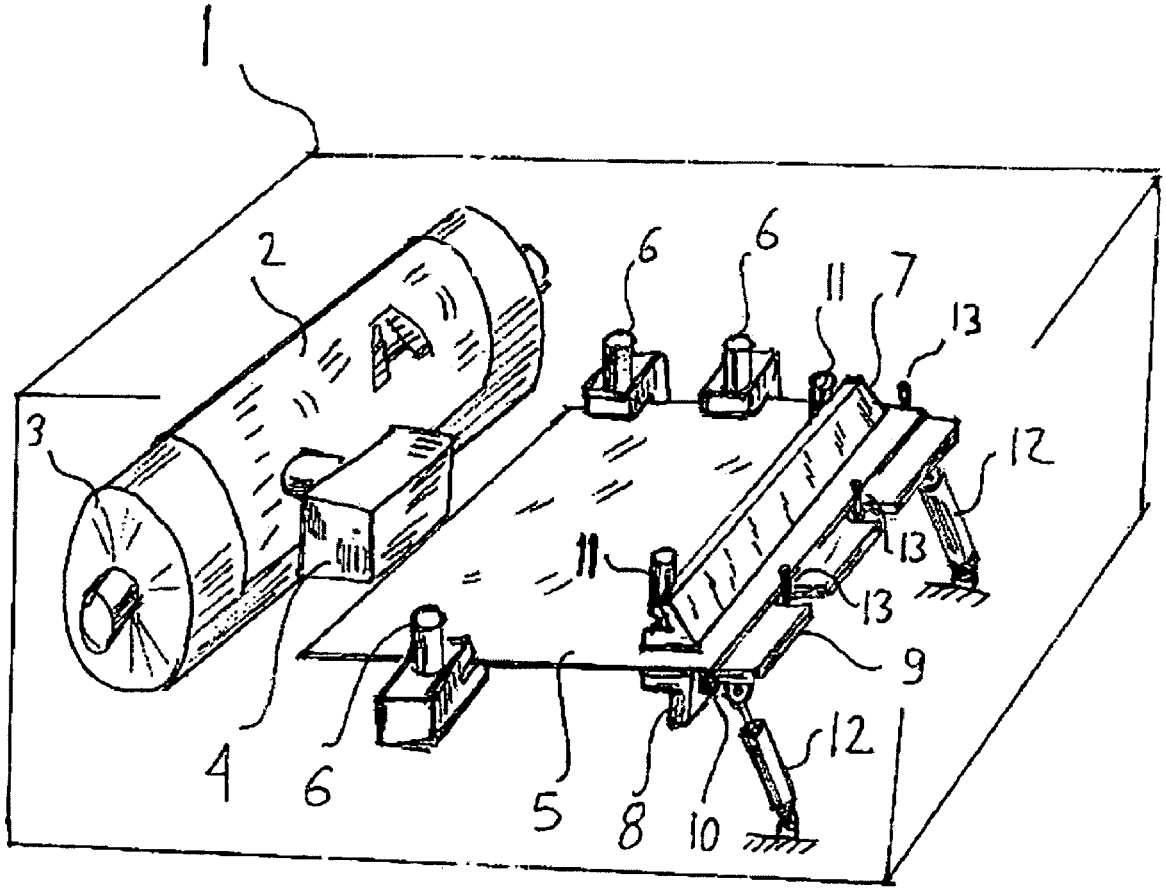
FIG. 3 is a view of the inside of a CTP platesetter according to one embodiment of the invention.

Referring now to FIG. 3: a CTP platesetter 1 includes an imaging system, shown schematically as plate 2 being imaged on drum 3 by imaging head 4. No further details of the CTP platesetter operation are shown, as CTP platesetters are commercially available and well understood. After the plate is imaged, it is bent. To increase throughput, a previously imaged plate 5 can be bent while plate 2 is being imaged. The plate edges can be punched, if so desired, before or after imaging by punches 6. No details of punch operation are given as many CTP platesetters incorporate automatic punching and it is considered prior art to this invention. For example, CTP platesetters sold by Creo (Canada), Agfa (USA) and Dai-Nippon Screen (Japan) include automatic punching either before or after imaging. The edge of plate 5 is sensed by optical means (laser or video camera) or by contacting register pins 13. For plates 5 which are made of aluminum or other conductive materials, it is easy to sense when the edge of plate 5 is touching the register pins 13, as plate 5 as it can be used to close an electrical circuit between pins 13. Closing the circuit activates punches 6 and pushes clamp down bar 7 against stationary bar 8, followed by bending using folder bar 9. Folder bar 9 pivots on pivot 10 and is activated, by the way of example, by pneumatic cylinders 12. Clamp down bar 7 is also pneumatically activated by cylinders 11.

Clearly, this embodiment is one of numerous possible embodiments. The actuation can be electrical instead of pneumatic; a press-brake arrangement can replace the folder-bar arrangement shown; a second bender can be used to bend the trailing edge of the plate etc. For sake of clarity the mechanisms needed to load and unload the plate from the drum 3 and to move the plate forward into the bender are not shown, as they are conventional in nature and exist in prior art CTP and automated bending machines such as the Nela-Ternes.

Referring now to FIG. 4, the various steps in punching and bending are shown in FIG. 4-*a* to FIG. 4-*c*. In FIG. 4-*a* plate 5 is moved into the bender until it touches register pins 13, closing an electrical circuit and starting the cycle. An equivalent method of registration, such as a video camera or laser edge detection can be used as well. When plate 5 touches pins 13, pneumatic cylinder 11 clamps plate 5 using bar 7 and stationary bar 8. Referring now to FIG. 4-*b:* in the clamped position, punches 6 are activated and punch the plate, and pneumatic cylinder 12 is activated and rotates folder bar 9 around pivot 10. The part is similar to the well-known sheet metal folders, used not only in plate bending, but in many sheet metal applications. In FIG. 4-*c,* folder bar 9 has completed the bend and will retract. Both punches 6 and clamp bar 7 can be retracted, freeing the plate to be delivered out of CTP platesetter 1, typically into a plate stacker (not shown), from which the press operator will pick them up.

When more than one plate bending configuration is needed, both the angle of the folder bar 9 and the location of register pins 13 can be controlled by computer according to the plate data. By way of example, a shaft encoder (not shown) can measure the bend angle and stop the process at the desired angle. Pins 13 can be mounted on a motorized carriage (not shown) and can be placed automatically according to the stored bend information.

In other embodiments of the invention, the order of operation can be changed. Thus, the punching and/or bending can be performed before imaging. If punching is performed before imaging, the punched holes can be used to register both the imaging and the bending in a similar manner to prior art systems.

Processless plates suitable for use with the present invention include Saphira (sold by Heidelberg of Germany); Applause and Anthem (sold by Presstek of N.H., USA) and Navajo (sold by Kodak Poychrome Graphics, USA). While the three examples of processless plates given here are exposed on thermal CTP platesetters, there are also processless plates available that can be exposed by UV light and there are CTP machines available for such plates, but they are not as common as the thermal CTP platesetters.

The term "thermal computer-to-plate platesetter" is used here to descirbe a CTP platesetter in which the laser that is employed by the machine to irradiate a printing plate precursor creates heat within the illuminated area of the plate and the heat then causes the change in the illuminated area, thereby rendering an image. Usually this heat is created indirectly, in that a light-to-heat converting compound added to the coating of the printing plate prcursor absorbs specifically at the wavelength of the incident laser light. The absorbed energy is then converted to heat. Often the wavelengths chosen for such platesetters are in the near-infrared, typically in the 700–1300 nm range. At these wavelengths, lasers that operate at the high power levels adequate for these applications are readily avaialble commercially.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A computer-to-plate platesetter for exposing processless printing plates, the computer-to-plate platesetter comprising an automatic plate bender positioned adjacent to an imaging system to receive imaged printing plates directly from said imaging system the automatic plate bender configured to form a sharp bend along at least one edge of an imaged printing plate, wherein the bender comprises an encoder connected to monitor a bend angle and a controller configured to stop forming a bend in a printing plate when the encoder indicates that a desired bend angle has been achieved.

2. A computer-to-plate platesetter according to claim 1 wherein the bender comprises a folder bar, wherein an angle of the folder bar is adjustable.

3. A computer-to-plate platesetter according to claim 2 wherein the bender comprises a set of register pins disposed to locate a printing plate to be bent, wherein a location of the register pins is adjustable.

* * * * *